US006302701B1

(12) United States Patent
Miller, Jr. et al.

(10) Patent No.: US 6,302,701 B1
(45) Date of Patent: Oct. 16, 2001

(54) RF CONNECTOR WITH IMPEDANCE MATCHING TAB

(75) Inventors: Thomas J. Miller, Jr., Fleetwood Township; Yuan-Hua Kao, Macungie; Bettina A. Nechay, Allentown, all of PA (US); Hidenori Nakanishi, Hyogo (JP); Takashi Igarashi, Hyogo (JP); Motoyoshi Tanaka, Hyogo (JP)

(73) Assignee: Agere Systems Optoelectronics Guardian Corp., Orlando, FL (US)

( * ) Notice: Subject to any disclaimer, the term of this patent is extended or adjusted under 35 U.S.C. 154(b) by 0 days.

(21) Appl. No.: 09/584,010

(22) Filed: May 30, 2000

(51) Int. Cl.[7] ..... H01R 12/00

(52) U.S. Cl. ..... 439/63; 333/260; 333/333; 439/581

(58) Field of Search ..... 439/581, 63; 361/392; 174/525, 35 R; 333/260, 33, 246, 238, 34

(56) References Cited

U.S. PATENT DOCUMENTS 2,940,007 * 6/1960 Thal, Jr. ..... 439/63
3,757,272 * 9/1973 Laramee et al. ..... 439/63
4,507,708 * 3/1985 Linberg ..... 361/392
4,556,265 * 12/1985 Cunningham ..... 439/63
5,133,676 * 7/1992 Hutchison et al. ..... 439/581
5,508,666 * 4/1996 Nguyen ..... 333/33
5,583,468 * 12/1996 Kielmeyer et al. ..... 333/33

OTHER PUBLICATIONS

IBM Technical Disclosure Bulletin, Air board controlled impedance Package, Nov. 1972, vol. 15, Issue 6, p. 1746–1747.*

* cited by examiner

*Primary Examiner*—Brian Sircus
*Assistant Examiner*—J. F. Duverne
(74) *Attorney, Agent, or Firm*—Duane, Morris & Heckscher LLP

(57) ABSTRACT

A sub-miniature push-on RF connector for connecting a transmission line to a signal sink. The connector has a shielded transmission line section having a signal line and a ground line extending axially through the connector. A center pin is coupled to the signal line and extends from the center of a front face of the connector in an axial direction. A semicircular tab coupled to the ground line extends from the front face of the connector substantially along the length of the center pin and partially surrounding the center pin to reduce an air gap impedance, the tab having first and second wire bonding surfaces at the ends of the semicircular shape thereof and disposed adjacent to said center pin.

8 Claims, 2 Drawing Sheets

RF CONNECTOR WITH IMPEDANCE MATCHING TAB

BACKGROUND OF THE INVENTION

1. Field of the Invention

The present invention relates to adaptors, interfaces, and connectors used to couple an electrical signal to an electrical component receiving the signal.

2. Description of the Related Art

There is a need to provide connection between signal sources and signal sinks, i.e. components receiving the electrical signal from the source. For example, a signal generator may generate a 10 Gb/S RF modulation signal, which is carried via coax cable to a modulator driver of a high speed laser module used for telecom applications. The driver helps to generate a modulated output laser beam which has a modulation obtained from the modulation signal.

At such high frequencies, it is important to provide for impedance matching for optimal electrical return loss, to minimize signal reflections and to optimize system performance. In general, impedance matching means that the impedance of the external device (sink), as well as the transmission line, matches that of the source. Improper impedance matching can lead to excessive distortion and noise problems such as signal reflection. Thus, transmission lines such as coaxial cables are often used for high-frequency RF signals, to provide uniform and matched impedance between the signal source and sink.

However, the connections between the end of the transmission line and the end component receiving the signal often introduce unwanted impedance into the signal path, thus causing signal reflection and adversely affecting system performance. For example, in a high speed laser module telecom application, the coax cable from the output of the signal generator is plugged into the receiving (input) end of an adaptor or connector such as an RF connector, by a standard coax type interface. The output side of the RF connector has an unshielded center pin. When the connector is inserted into the appropriate receptacle of the laser module housing, the center pin (typically about 0.7 mm in length) is wire bonded to the modulator driver (signal sink). The driver uses the RF modulation signal carried by the coax cable to modulate a laser beam.

The coax cable can be designed to have a uniform impedance such as 50Ω, which matches an input impedance of 50Ω of the modulator driver. However, there will be an air gap between the face of the RF connector, along the exposed, unshielded length of the center pin, to the modulator driver. This mismatching will introduce unwanted signal reflections and other undesirable effects, thus degrading system performance.

Previous attempts to address this problem involve use of discrete adaptors and interfaces from the end user's RF signal to the end component receiving the signal. However, using an increased number of pieces reduces overall performance, and results in higher cost and more complex end product manufacturing. Further, when discrete components are used, there is always an interface issue with associated performance degradation. Discrete components also increase performance variation.

SUMMARY

According to the present invention, a sub-miniature push-on RF connector is provided for connecting a transmission line to a signal sink. The connector has a shielded transmission line section having a signal line and a ground line extending axially through the connector. A center pin is coupled to the signal line and extends from the center of a front face of the connector in an axial direction. A semicircular tab coupled to the ground line extends from the front face of the connector substantially along the length of the center pin and partially surrounding the center pin to reduce an air gap impedance, the tab having first and second wire bonding surfaces at the ends of the semicircular shape thereof and disposed adjacent to said center pin.

DESCRIPTION OF THE PREFERRED EMBODIMENT

Figure 1:
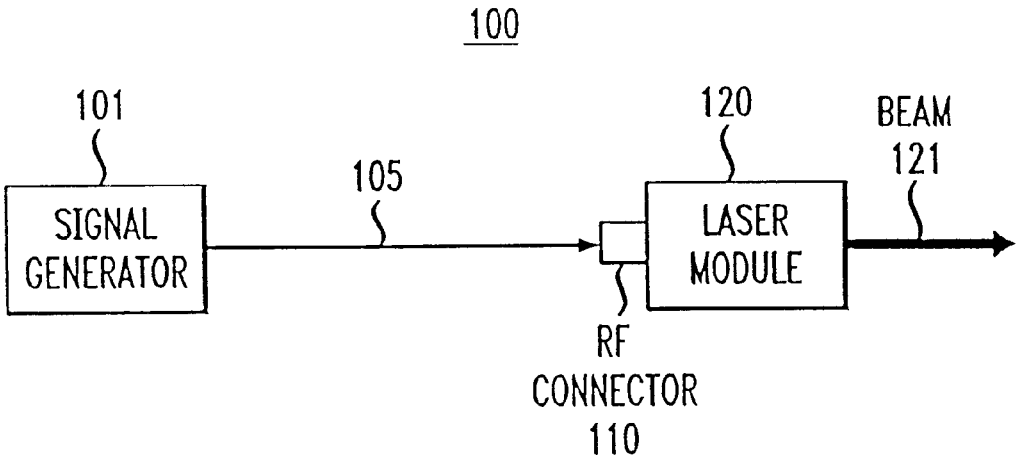
FIG. 1 is a block diagram of a system employing the improved RF connector of the present invention.

Referring now to FIG. 1, there is shown a block diagram of a system 100 employing an improved RF connector 110, having an impedance matching tab for improved impedance atching, connection, and signal transmission. As illustrated, a signal generator 101 produces a high frequency (e.g., 10 Gb/s) RF signal, which is carried by coax cable 105. Coax cable is attached to the input of RF connector 110, e.g. by a bullet plug or standard coax interface. RF connector 110 of the present invention is inserted into the appropriate receptacle of high-speed laser module 120, which produces modulated output laser beam 121.

Figure 2:
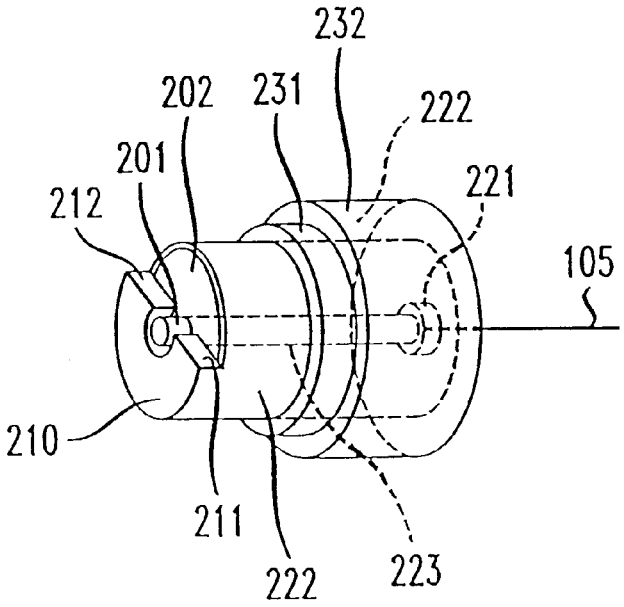
FIG. 2 is a perspective view of the improved sub-miniature push-on (SMP), RF connector with impedance matching tab of the system of FIG. 1, in accordance with an embodiment of the present invention.

Referring now to FIG. 2, there is shown a perspective view of improved RF connector 110 of FIG. 1, in accordance with an embodiment of the present invention. RF connector 110 is preferably a sub-miniature push-on (SMP) type RF connector, also comprising impedance matching tab 210. As illustrated, coax cable 105 attaches to the back (input) end of SMP RF connector 110. At the front (output) end of RF connector 110, center pin 201 extends for about 0.7 mm from front face 202.

Center pin 201 is electrically coupled at its base (at surface 202) to the signal line 223 of a shielded transmission line section of connector 110, which extends axially through the connector housing. Shielded transmission line section also comprises shielding or ground line 222. Center pin 201 extends from the center of front face 202 of the connector in an axial direction. In an embodiment, it is an extension of signal line 223. At the other (back) end of connector 110, the shielded transmission line section terminates in a receptacle or input terminal 221 for mating to a shielded transmission line (coax line 105) having a signal line and a ground line. Thus, when coax line 105 is plugged into the input terminal of connector 110, its signal line is electrically coupled with the signal line 223 of connector 110, and thus to the center pin 210, and its ground line (i.e. shielding) is electrically connected to the ground line portion 222 of RF connector's shielded transmission line section.

A semicircular, "U-shaped" impedance matching tab 210 extends from front face 202 of connector 210 substantially along the length of the center pin, and partially surrounding center pin 201 along the extent of the thickness of matching tab 210. Tab 210 is electrically coupled to the ground line of the shielded transmission line section of connector 110, and thus to the RF ground of coax cable 105.

Tab 210 has two substantially flat and parallel end surfaces 211, 212, which are next and close to center pin 201. Surfaces 211, 212 may be referred to as first and second wire bonding surfaces, which are at the ends of the semicircular shape of tab 210, and which are disposed adjacent to the center pin 201. End surfaces 211, 212 are substantially aligned along lines radiating from center pin 201, so that wire bonding may be done on the top of center pin 201 and on top of nearby surfaces 211, 212. In an embodiment, surfaces 211, 212 are in a plane slightly higher than the exact axial center of pin 201, so that wire bonded onto the top of center pin 201 would be substantially on the same level as wire bonded on surfaces 211, 212. If surfaces 211, 212 are much higher than the top of pin 201, it would be more difficult to wire bond pin 201 to an input terminal of a signal. If surfaces 211, 212 are much lower than the top of pin 201, then it may be difficult to wire bond the surfaces 211, 212 to ground terminals in the same process as the wire bonding of center pin 201, and the level of shielding and thus protection from air gap impedance is reduced. Thus, connector 110 is an SMP RF connector for connecting a transmission line (105) to a signal sink (420 in FIG. 4).

Figure 3:
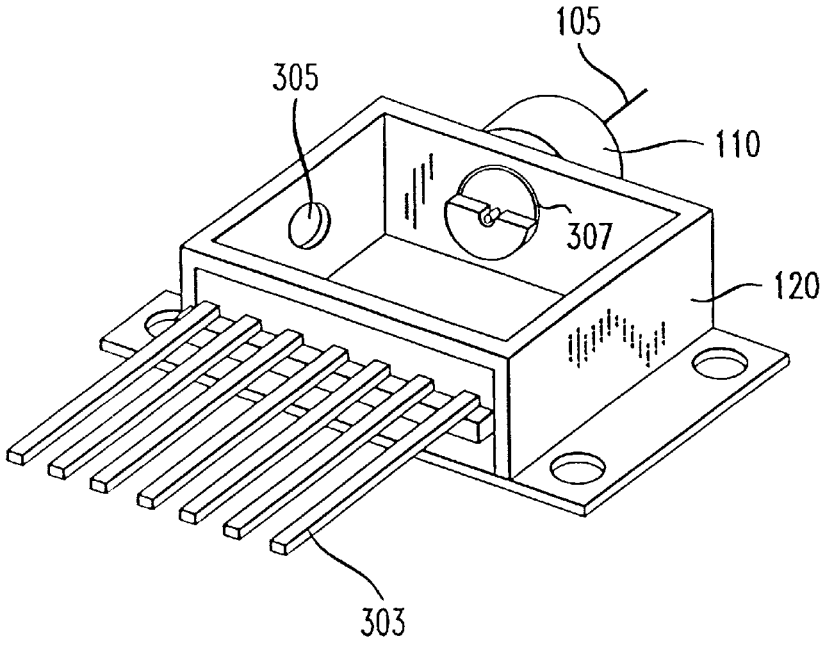
FIG. 3 illustrates the SMP RF connector of FIG. 2 inserted into a receptacle of a laser module of the system of FIG. 1.

Referring now to FIG. 3, there is shown the SMP RF connector 110 assembled in high speed laser module 120 of system 100. RF connector 110 is inserted into a receptacle 307 of module 120. Other components of laser module 120 (such as the modulator driver and laser device) are not shown, for simplicity of illustration. An output laser beam is emitted via opening 305. Electrical contacts 303 provide for connection between other components and sources outside module 120 and the components contained therein, e.g. to the modulator driver.

Tab 210 partially surrounds the center pin 201 along center pin 201's length, thereby reducing the air gap impedance that would otherwise be introduced by the air gap around center pin 201. As will be appreciated, tab 210 provides a good deal of shielding for centerpin 201, because it partially surrounds and is so close to center pin 201. This significantly reduces the impedance that would otherwise be introduced along the air gap length of center pin 201, if it were completely unshielded, as in prior art connectors. Thus, the center pin and the air gap between the face 202 of the connector and the bonding to wires connected to the sink device, do not degrade impedance matching (introduce impedance, or impedance mismatch) to the extent that would be the case in the absence of impedance matching tab 210. Thus, tab 210 helps to ensure impedance matching between source and sink, and along the transmission line. Further, tab 210 provides easy wire bonding access from the end component to the RF ground, due to the placement of surfaces 211, 212.

The housing of RF connector 110 has an outer portion 232 and inner portion 231, in an embodiment. The inner portion 231, in an embodiment, has a shoulder or ledge which serves as a stop when RF connector 110 is inserted into receptacle 307 of module 120. Outer portion 232 may have "timing flats" (not shown) manufactured into the sides thereof. As will be appreciated, these timing flats are opposing flat surfaces in the otherwise circular cross-section of outer portion 232, which may be used for precise alignment of RF connector 110, e.g. to align the RF connector parallel to the package base, as often required in telecom applications.

Figure 4:
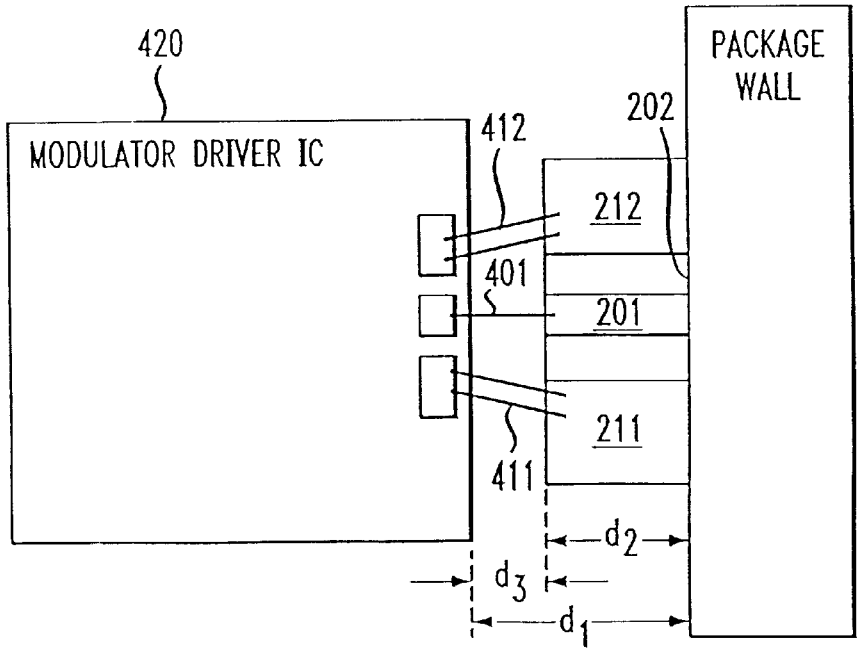
FIG. 4 is a top view illustration of the SMP RF connector of FIG. 2 wire bonded at its center pin and impedance matching tab to a modulator driver.

Referring now to FIG. 4, there is shown a top view illustration of the SMP RF connector 110 wire bonded at its center pin 201 and impedance matching tab 210 to a modulator driver 420. As shown, the signal input pin of driver 420 is bonded by bonding wire 401 to the top surface of center pin 201, near its tip (far end). The ground terminals of driver 420 are wire bonded to each of surfaces 211, 212, by bonding wires 411, 412, respectively. In the implementation illustrated in FIG. 4, two closely-spaced bonding wires 412 are used to connect to face 212 of impedance matching tab 210, and two closely-spaced bonding wires 411 connect the ground of driver 420 to surface 211 of impedance matching tab 210. In an alternative embodiment, different number of bonding wires may be employed to connect each of faces 211, 212 to the corresponding ground terminal of driver 420. For example, a single bonding wire may be employed, or three, or two pairs of two.

In FIG. 4, the length $d_2$ represents approximately the distance from the face 202 of connector 110, in an axial direction, to approximately the end of center pin 201, approximately 0.7 mm. Length $d_3$ represents the length from the end of pin 201 and the outer face of tab 210 (roughly where the wires are bonded to these elements), to the terminals of the sink device (driver 420). The length $d_1$ is the sum of $d_2$ and $d_3$, and represents the distance from the face 202 of connector 110, in an axial direction, to the terminals of driver 420.

As shown, the use of impedance matching tab 210 reduces the air gap from distance d, to the shorter distance $d_3$. Further, the presence of impedance matching tab 210 makes it possible to easily wire bond ground terminals of driver 420 to surfaces 211, 212, by bond wires 411,412, respectively. Without impedance matching tab 210, the air gap over distance $d_2$ would still be present, and it would be more difficult to connect the ground terminals of driver 420 to the RF ground. By eliminating the air gap over distance $d_2$, and by providing precise and similar wire bond lengths for bond wires 411, 412, 401, electrical return loss is optimized and the impedance of the signal path remains matched. Empirical results indicate that the use of impedance matching tab 210 significantly improves the performance in a high-speed telecom application, over that achieved when using a connector without an impedance matching tab.

The SMP RF connector of the present invention thus provides for improved impedance matching and performance, in a single package, without having to employ a discrete connector and matching element components. The present invention also eliminates RF performance dependence on laser package vendors because the key RF performance elements are embodied in a portable connector that requires only a simple hole in the package shell for installation. In addition, the SMP RF connector has simple, cost-effective timing flats to install the part in a package with the required parallelism to the package base. The physical requirements and tolerances on the package are therefore minimized, allowing for substantial cost reduction of the package body.

In an alternative embodiment, pin 201 is not necessarily in the exact center of face 202, but may be off-center. In this case, tab 210 will not necessarily be semicircular, but will still partly wrap around pin 201 so as to reduce the air gap impedance, and will terminate in two wire bonding surfaces next to the top of pin 201. In a preferred embodiment, tab 210 is molded as an integral part of RF connector 110, and, in particular, is an integral part and extension of ground line section 222. In an alternative embodiment, tab 210 may be added onto face 201 and bonded, for example, to ground line 222.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. A connector for connecting a transmission line to a signal sink, comprising:

(a) a shielded transmission line section having a signal line and a ground line;

(b) a signal pin coupled to the signal line and extending from a front face of the connector in an axial direction; and (c) an impedance matching tab coupled to the ground line and extending from the front face of the connector substantially along the length of the center pin and partially surrounding the center pin to reduce an air gap impedance, the tab having first and second wire bonding surfaces at the ends thereof and disposed adjacent to said center pin.

2. The connector of claim 1, wherein the connector is an RF connector.

3. The connector of claim 2, wherein the connector is a sub-miniature push-on RF connector.

4. The connector of claim 1, wherein the first and second wire bonding surfaces of the tab are substantially flat and parallel to each other.

5. The connector of claim 1, further comprising an input terminal for mating to a shielded transmission line having a signal line and a ground line.

6. The connector of claim 5, wherein the shielded transmission line is a coaxial transmission line.

7. The connector of claim 1, wherein the signal pin is a center pin extending from the center of the front face of the connector, and the impedance matching tab is a semicircular tab, wherein the first and second wire bonding surfaces are at the ends of the semicircular shape of the tab.

8. The connector of claim 1, wherein the impedance matching tab is a semicircular tab, wherein the first and second wire bonding surfaces are at the ends of the semicircular shape of the tab.

* * * * *